US008056426B2

(12) United States Patent
Hohmann et al.

(10) Patent No.: US 8,056,426 B2
(45) Date of Patent: Nov. 15, 2011

(54) METHOD AND DEVICE FOR CONTROLLING A HYDRAULICALLY OPERATED POWER WRENCH

(76) Inventors: Jörg Hohmann, Meschede (DE); Frank Hohmann, Warstein (DE)

( * ) Notice: Subject to any disclaimer, the term of this patent is extended or adjusted under 35 U.S.C. 154(b) by 460 days.

(21) Appl. No.: 12/425,423

(22) Filed: Apr. 17, 2009

(65) Prior Publication Data

US 2009/0260485 A1 Oct. 22, 2009

(30) Foreign Application Priority Data

Apr. 18, 2008 (DE) ..... 10 2008 019 765

(51) Int. Cl.
*B25B 23/14* (2006.01)

(52) U.S. Cl. ..... 73/862.23

(58) Field of Classification Search ... 73/862.21–862.23
See application file for complete search history.

(56) References Cited

U.S. PATENT DOCUMENTS 4,864,903 A * 9/1989 Bickford et al. ..... 81/467
4,941,362 A * 7/1990 Tambini ..... 73/862.23
5,668,328 A * 9/1997 Steber et al. ..... 73/862.23
7,661,336 B2 * 2/2010 Hohmann et al. ..... 81/57.38
7,743,673 B2 * 6/2010 Wagner et al. ..... 73/862.23
2005/0210872 A1 9/2005 Wagner
2007/0214921 A1 * 9/2007 Fechter et al. ..... 81/467

* cited by examiner

*Primary Examiner* — Lisa Caputo
*Assistant Examiner* — Octavia Davis
(74) *Attorney, Agent, or Firm* — Gudrun E. Huckett

(57) ABSTRACT

In a method for controlling a hydraulic power wrench with a pivotable lever pivoted by a piston-cylinder unit and a ratchet arrangement for stepwise rotation of a ratchet bushing by advancing and return strokes, parameters such as nominal torque or pre-load or screw parameters are entered into an electronic input unit. Nominal pressure corresponding to the parameters is determined by an electronic evaluation unit and generated by the pump. The piston-cylinder unit is pressure-loaded for performing a pre-stroke until the nominal pressure is reached followed immediately by a return stroke. A time interval from beginning of pressure loading until reaching nominal pressure or until reaching an initial pressure after pressure relief is measured. Pressure loading and measuring are repeated. The measured time intervals are compared. Pressure loading cycles are stopped when at least the last measured time interval is shorter than at least the penultimate measured time interval.

11 Claims, 2 Drawing Sheets

METHOD AND DEVICE FOR CONTROLLING A HYDRAULICALLY OPERATED POWER WRENCH

BACKGROUND OF THE INVENTION

The invention relates to a method and a device for controlling a hydraulically operated power wrench comprising a pivotable lever pivoted by a piston-cylinder unit and provided with a ratchet arrangement for stepwise rotation of a ratchet bushing by advancing and returning strokes and further comprising a drive unit with a motor-driven pump.

US 2005/0210872 A1 discloses such a method and a device in which the change of the hydraulic pressure is measured in time intervals and the working process is terminated when the increase of hydraulic pressure for a load stroke within a predetermined time is smaller than a predetermined limit value, wherein the pressure loading cycles cause alternating advancing strokes and return strokes and wherein during the load stroke the temporal change of the hydraulic pressure is measured in time intervals and switching to a return stroke is realized when in at least one of the time intervals the pressure increase is greater than in at least one of the preceding intervals of the working process.

In order to carry out the method as described, the operator first sets a nominal pressure which is that pressure that determines the torque of the screw to be turned and at which pressure the working process can be terminated. The characteristic pressure/time curve of the respective pressure device is determined prior to operation and saved. The slope of the pressure increase curve is determined in that the pressure is measured in time intervals of 10 ms. Since the time intervals have all the same duration, for determination of the differential quotient $y=dP/dt$ the pressure difference $dP$ occurring within a time interval is evaluated and saved in digital form. When the terminal pressure is reached the pressure remains constant and the differential quotient $dP/dt=0$.

In this method it is not only necessary to carry out before the actual working process a calibration but it is also required to carry out continuously pressure measurements in time intervals of 10 ms in order to determine the pressure increase that serves as a criterion for switching from advancing stroke to return stroke and for switching off upon reaching the nominal pressure value without further turning the nut or the screw.

SUMMARY OF THE INVENTION

It is an object of the present invention to provide a method and a device for controlling a hydraulically operated power wrench in such a way that with minimal expenditure it is possible to carry out the control action of the power wrench up to the point of reaching the nominal torque.

In accordance with the present invention, this is achieved in that a method for controlling, during the tightening action of a screw connection, a hydraulically operated power wrench, comprising a pivotable lever pivoted by a piston-cylinder unit and provided with a ratchet arrangement for a stepwise rotation of a ratchet bushing by advancing strokes and return strokes and a drive unit with a motor-driven pump, is proposed that, according to the invention, comprises the following steps:

- Entering a nominal torque or a nominal pre-load or a screw size, material quality, thread pitch, and clamping length into an electronic input unit;
- Determining by means of an electronic evaluation unit a nominal pressure to be generated by the pump that matches the nominal torque the nominal pre-load or the screw size, material quality, thread pitch, and clamping length;
- Pressure loading of the piston-cylinder unit for performing the advancing stroke until the nominal pressure is reached and immediate reverse control to return stroke upon reaching the nominal pressure by pressure relief and spring pressure or by controlling pressure loading of the piston-cylinder unit to effect return stroke;
- Measuring the time from beginning of pressure loading until the nominal pressure is reached or until the initial pressure is reached after pressure relief;
- Repeating pressure loading and pressure relief and measuring the time until the nominal pressure or the initial pressure is reached;
- Comparing the measured time intervals and switching off the pressure loading cycles when at least the last measured time interval is shorter than at least the penultimate measured time interval.

According to the invention, the entire time intervals of an advancing stroke or of an advancing stroke and a return stroke are measured and it is not required to divide these time intervals into even shorter time intervals for a pressure measurement. Pressure measurement is not required because it is sufficient to adjust the nominal pressure in accordance with the requirements since each pressure loading cycle is carried out up to the point of reaching this nominal pressure and then immediately the return stroke is carried out.

The invention is based on the principle that all pressure loading cycles that are correlated with a nut or screw rotation happen over a longer time interval than pressure loading cycles that are carried out without nut or screw rotation when they are tightened to the entered nominal torque because the elements of the power wrench are no longer moving and the pressure increase and pressure drop occurs only for a duration that corresponds to the resilience in the elements of the power wrench and possibly the hydraulic conduits. These last time intervals are significantly shorter than the preceding time intervals so that a comparison of the duration of these last time intervals with the preceding longer time intervals can be utilized directly as a switching-off criterion without calibration and measuring of absolute values being required.

For compensation of smaller fluctuations in the measured time intervals the following can be done: after determining a first short time interval two further pressure loading steps are carried out and, based on these three short time intervals and three prior longer measured time intervals, an average or a sum is calculated and the repeated pressure loading cycles are switched off when the average or the sum of the short time intervals is smaller than the average or the sum of the longer time intervals.

Since the time intervals for screwing on the loose nut or screw until the point of biting (gripping) of the nut or screw is shorter than the following time intervals for tightening the nut or screw and, up to the moment of starting the tightening step of the nut or screw, not more than five pressure loading cycles are required, it is possible to check whether tightening of the nut or screw after biting has taken place or not or whether the nut or screw is one that has already been tightened in that the duration, for example, of the first six pressure loading cycles is measured and the pressure loading cycles are switched off when the duration of these six time intervals is shorter than a predetermined time interval corresponding to a screwing process.

This determination is an indication that the nut or screw is blocked without having been tightened or that the nut or screw is one that has already been tightened to the nominal torque so that it is possible to generate an error message by means of the electronic evaluation unit when the pressure loading cycles are switched off immediately at the time of screwing on the loose nut or screw.

Whether the pressure loading cycles occur in a normal fashion can be recognized in that, when measuring the time intervals for screwing on the loose nut or screw up to the moment of biting, the time intervals for tightening the nut or screw up to the moment of reaching the nominal pressure corresponding to the nominal torque, and the time intervals after having reached the nominal pressure corresponding to the nominal torque without further rotation of the nut or the screw, it is found that the time intervals for screwing on the loose nut and the time intervals after having reached the nominal pressure corresponding to the nominal torque without further rotation of the nut or screw are shorter than the time intervals for tightening the nut so that the repeated pressure loading cycles can be switched off when at least the last time interval is shorter than the prior ones.

The aforementioned object is solved also by a hydraulically operated power wrench for performing the aforementioned method. The power wrench comprises a pivotable lever pivoted by a piston-cylinder unit; a ratchet arrangement for stepwise rotation of a ratchet bushing; a drive unit with a motor-driven pump, an electronic input unit for entering parameters such as a nominal torque or a nominal pre-load force or the screw size, material quality, thread pitch, and clamping length; an electronic evaluation unit for determining a nominal pressure based on the input parameters; an adjustable pressure valve that is arranged between the piston-cylinder unit and the pump and is adjustable to the nominal pressure; an actual pressure sensor; a time measuring device for measuring the time interval of each pressure loading step from the initial pressure up to the nominal pressure or from the beginning of pressure loading up to the nominal pressure and subsequent pressure relief until the initial pressure is reached, wherein the electronic evaluation unit according to the invention is configured to control the pressure loading cycles, taking into account the measured time intervals, in such a way that the pressure loading cycles are switched off when at least the last measured time interval is shorter than the penultimate one.

In addition, the electronic evaluation unit can be configured such that based on three short time intervals and three longer time intervals that have been measured immediately before, average values or the sum are calculated and the pressure loading cycles are switched off when the average value or the sum of the short time intervals is shorter than the average value or the sum of the longer time intervals.

It is moreover also possible to configure the electronic evaluation unit such that the duration of the first, for example, six, time intervals of the pressure loading cycles is measured and the pressure loading cycles are switched off when the duration of these six time intervals is shorter than a preset time interval that corresponds to a screw-on action. In this case the electronic evaluation unit may generate an error message when the pressure loading cycle immediately after screwing on the nut or the screw are switched off.

Finally, the electronic evaluation unit can also be configured to measure the time intervals during the screwing-on step of the loose nut or screw up to the moment of biting, the time intervals during the tightening step of the nut or the screw up to the moment of reaching the nominal pressure corresponding to the nominal torque, and at least one time interval after having reached the nominal pressure corresponding to the nominal torque without further rotation of the nut or screw, and to switch off the repeated pressure loading cycles when at least the last measured time interval is shorted than the preceding ones.

DESCRIPTION OF THE PREFERRED EMBODIMENTS

Figure 1:
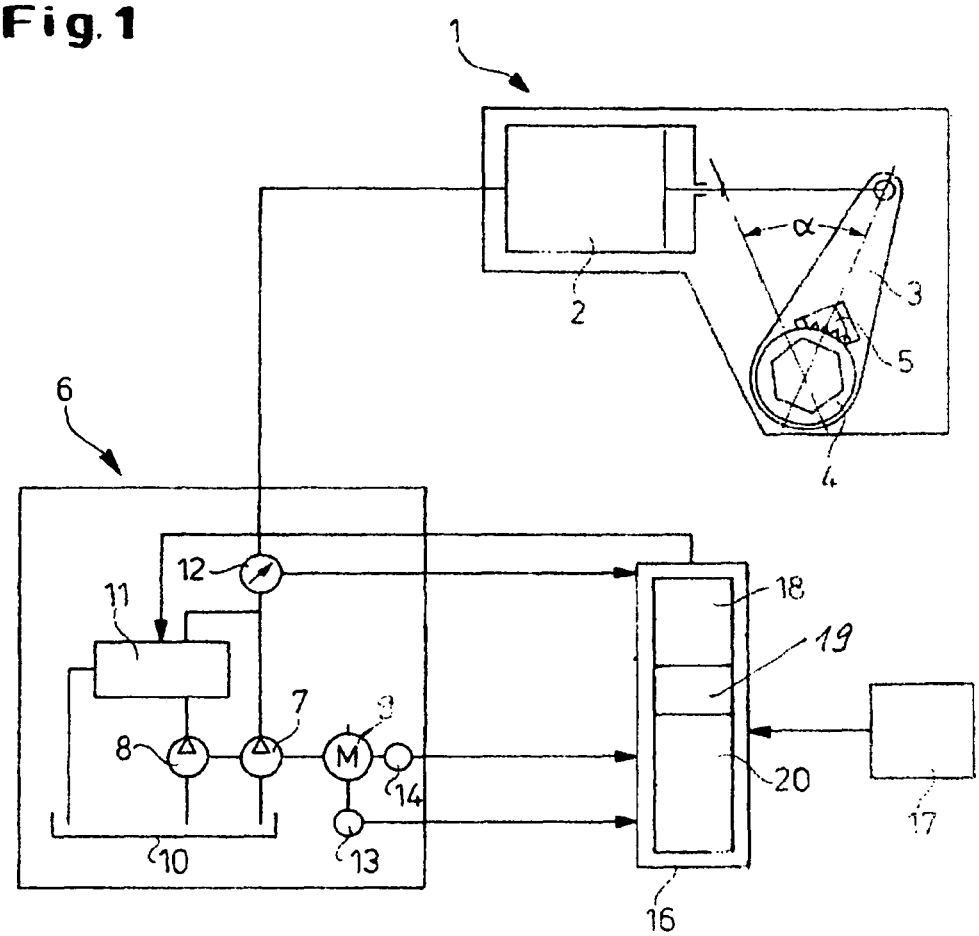
FIG. 1 is a schematic illustration of a power wrench according to the invention with drive unit and electronic control unit.

A hydraulically operated power wrench 1 comprises a piston-cylinder unit 2, a pivotable lever 3 that is loaded and pivoted by the piston-cylinder unit 2 and is provided with a ratchet arrangement 5 for a stepwise rotation of ratchet bushing 4. Between stops in the piston-cylinder unit 2 a pivot angle $\alpha$ of the lever 3 is defined. This corresponds to the complete stroke of the piston-cylinder unit. Accordingly, between the stroke H and the pivot angle $\alpha$ there is a fixed geometric relation.

Pivoting of the pivot lever 3 for tightening a screw or nut, not illustrated, is realized by loading the piston-cylinder unit 2 with hydraulic oil from a drive unit 6 while the return stroke of the lever 3 is effected by a restoring spring, not illustrated. The return stroke is a no-load stroke because the ratchet arrangement during the return stroke releases the rotational connection between the lever 3 and the ratchet bushing 4. Instead of a restoring spring the return stroke of the lever 3 can also be realized by a reverse loading of the piston-cylinder unit 2 with hydraulic oil.

In the illustrated embodiment the drive unit 6 has two parallel-connected pumps 7, 8 that are designed as piston pumps of different conveying volume. The drive of the pumps 7, 8 is realized by a common drive motor 9 that in the illustrated embodiment is an electric motor. The pressure side of the pumps 7, 8 is connected to a combined switching and pressure control valve 11. Moreover, in the pressure conduit to the power wrench 1 a pressure sensor 12 is arranged. Instead of the pressure sensor 12 arranged in the pressure conduit, the measurement of the pressure in the pressure conduit can also be realized by means of a current drain measuring device 13 connected to the drive motor 9 or by means of a phase angle measuring device 14 connected to the drive motor 9.

An electronic control unit 16 controlling the drive unit 6 is connected to an electronic input unit 17, preferably a keypad, and has inputs for the pressure sensor 12 and/or the pressure measuring device 13 and/or the phase angle measuring device 14. An output of the electronic control unit 16 is connected to the switching and pressure control valve 11. The electronic control unit 16 comprises an electronic evaluation unit 18 for determining the nominal pressure based on the screw parameters input into the electronic input unit 17, i.e., a nominal torque or a nominal pre-load force or the screw size, thread pitch, and clamping length. Moreover, the electronic control unit 16 comprises a time measuring unit 19 as well as a control and switching-off device 20 for switching off the movement of the piston-cylinder unit 2 when the nominal torque is reached.

Tightening of the screw connection by means of the power wrench illustrated in FIG. 1 is realized in the following way, reference being had to FIG. 2.

First, in the electronic input unit 17 the nominal torque or the nominal pre-load or screw size, material quality, thread pitch, and clamping length are input and from there sent to the electronic evaluation unit 18 in the electronic control unit 16. The electronic evaluation unit 18 determines based on these entered tightening parameters a nominal pressure because the nominal pressure is directly proportional to the nominal torque and to the nominal pre-load.

The nominal pre-load or the nominal torque is predetermined by the modulus of elasticity of the screw material, the permissible tensile strength, i.e., the material quality, the shaft cross-section and the screw length, and can be provided directly on the screw or listed in a table. The electronic evaluation unit 18 however can also determine the nominal pre-load, based on it the nominal torque, and based on the latter the nominal pressure when the screw material, screw quality, screw size, thread pitch, and the clamping length are entered.

When the nominal pressure has been determined (optionally, it can be displayed together with the entered screw parameters on a monitor, not illustrated), the motor 9 for driving the pumps 7, 8 is started or, in case of a continuously running drive motor 9, a pressure relief valve is closed in the switching and pressure control valve 11 so that in the pressure conduit to the power wrench 1 the pump pressure is built up. This pressure increases initially for screwing on the loose screw or nut to the nominal pressure until the moment of biting; the nominal pressure is reached at the point in time t1. During this time the ratchet bushing 4 is rotated about the complete pre-stroke without encountering great resistance. Immediately upon reaching the nominal pressure at the point in time t1 the switching and pressure control valve 11 is switched to pressure relief, a spring, not illustrated, effects the no-load stroke of the piston-cylinder unit 2, and the hydraulic oil contained therein is returned through the switching and pressure control valve 11 into a hydraulic oil reservoir 10 from where it is pumped by the pumps 7, 8. During the return stroke the pressure drops from the point in time t1 to the point in time t2 to the initial pressure and the entire time interval $\Delta t_1$—comprised of advancing stroke and return stroke—is measured.

Alternatively, it is possible to measure only the time interval up to the point in time $t_1$ because this duration alone is sufficient in order to serve as an evaluation criterion for switching off the pressure loading cycles as will be explained in the following.

After the loose screw or nut has been turned during several pressure loading cycles (in the illustrated embodiment three cycles) until the point of biting has been reached, further tightening of the nut or screw is done stepwise wherein the time intervals $\Delta t_4$, $\Delta t_5$, $\Delta t_6$ are measured. The stepwise tightening of the nut or screw until the nominal pressure is reached, is realized, as illustrated, in time intervals that are longer than the preceding ones because tightening of the nut or screw requires a significant force and the pressure buildup until the nominal pressure is reached is therefore slower.

During these pressure loading cycles either the entire time interval $\Delta t_4$, $\Delta t_5$, $\Delta t_6$ measured between the points in time $t_6$, $t_8$, $t_{10}$, $t_{12}$ can be measured but a useful evaluation criterion is also provided when only the time intervals between the points in time $t_6$, $t_7$; $t_8$, $t_9$; and $t_{10}$, $t_{11}$ are measured.

After the nut or screw has been tightened to the required nominal torque, i.e., to the nominal pressure and no longer turns further, and a further pressure loading beginning at the point in time $t_{12}$ is realized, the pressure increase from the initial pressure to the nominal pressure and the pressure drop back to the initial pressure again happen very fast because the elements of the power wrench 1 will move only minimally as a result of resilience of the components and the hose connections so that the measured time intervals $\Delta t_7$, $\Delta t_8$, $\Delta t_9$ are always shorter than the preceding time intervals.

Figure 2:
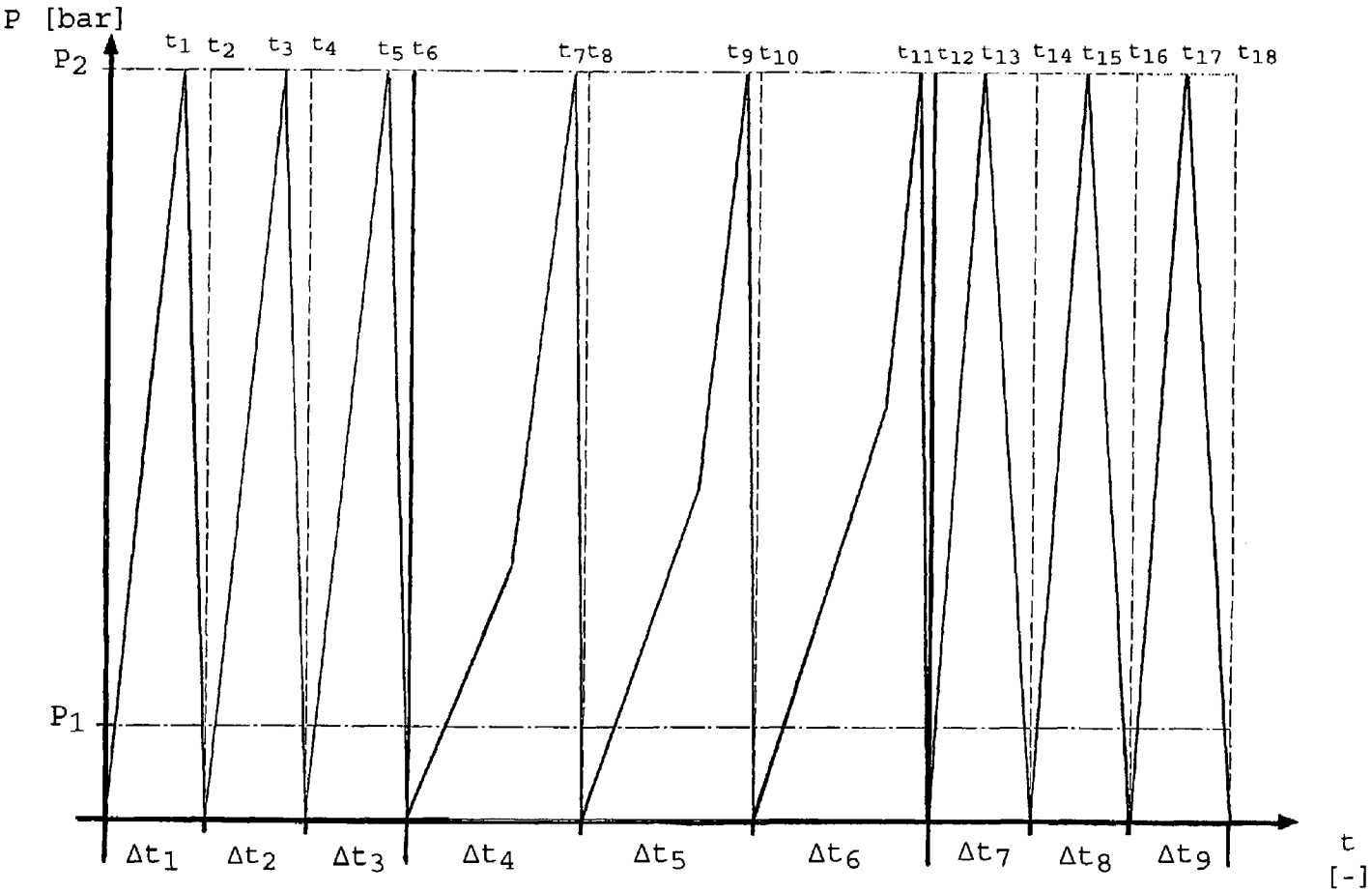
FIG. 2 is a schematic illustration of the pressure course during screw tightening.

Since in FIG. 2 the normal situation of proper tightening of a screw connection is illustrated, it is in principle sufficient to compare only the time intervals $\Delta t_6$ and $\Delta t_7$ and to terminate the tightening process when the time interval $\Delta t_7$ is shorter than the time interval $\Delta t_6$.

However in order to refine the measurement and to eliminate irregularities during the pressure increase, according to a further embodiment of the invention based on the time intervals $\Delta t_4$, $\Delta t_5$, $\Delta t_6$ as well as the time intervals $\Delta t_7$, $\Delta t_8$, $\Delta t_9$ the average values are calculated or the sum is simply calculated, respectively, and compared to one another so that the working process is stopped when the average values of the time intervals $\Delta t_7$, $\Delta t_8$, $\Delta t_9$ as well as of the time intervals $\Delta t_4$, $\Delta t_5$, $\Delta t_6$ fulfill the switching-off criterion. The step of calculating the average can be eliminated when only the sums of the aforementioned time intervals are compared to one another in order to fulfill the switching-off criterion.

The time measurement can also serve for determining an error when tightening a screw connection. When a nut or screw from the beginning cannot be turned because it is already tightened or because it is blocked for any other reason, the longer time intervals $\Delta t_4$, $\Delta t_5$, $\Delta t_6$ are no longer present and only the time intervals $\Delta t_1$, $\Delta t_2$, $\Delta t_3$ as well as three further short time intervals $\Delta t_i$ are measured so that this is a sign for an already tightened nut or screw or for an improper tightening of the nut or screw. The electronic evaluation unit 18 can generate an error signal based on this that is displayed on a monitor, not illustrated.

Therefore, the method according to the invention and the corresponding device require only a simple time measurement in order to control the power wrench 1 for tightening a screw connection until a predetermined nominal torque is reached without this requiring interaction of the operating personnel. By means of the method according to the invention and the corresponding device it is thus possible to effect tightening of a screw connection remotely and, moreover, to control several screw connections simultaneously by means of an electronic control unit 16.

The specification incorporates by reference the entire disclosure of German priority document 10 2008 019 765.3 having a filing date of Apr. 18, 2008.

While specific embodiments of the invention have been shown and described in detail to illustrate the inventive principles, it will be understood that the invention may be embodied otherwise without departing from such principles.

What is claimed is:

1. A method for controlling a hydraulically operated power wrench comprising a pivotable lever pivoted by a piston-cylinder unit, comprising a ratchet arrangement for a stepwise rotation of ratchet bushing by advancing strokes and return strokes, and a drive unit with a motor-driven pump for tightening a screw connection; the method comprising:

a) entering a nominal torque or a nominal pre-load or a screw size, material quality, pitch of a thread, and clamping length into an electronic input unit;

b) determining with an electronic evaluation unit a nominal pressure to be generated by the pump, which nominal pressure corresponds to the nominal torque or the nominal pre-load or the screw size, material quality, thread pitch, and clamping length;

c) pressure loading of the piston-cylinder unit for performing a pre-stroke until the nominal pressure is reached and immediate reversing to a return stroke upon reaching the nominal pressure by pressure relief and spring pressure or by controlling pressure loading of the piston-cylinder unit to perform a return stroke;

d) measuring a time interval from beginning of the pressure loading step until the nominal pressure is reached or until an initial pressure after pressure relief is reached;

e) repeating the steps c) and d);

f) comparing the measured time intervals and switching off the pressure loading cycles according to the step c) when at least the last measured time interval is shorter than at least the penultimate measured time interval.

2. The method according to claim 1, wherein, after determination of a first short measured time interval in step f), two further pressure loading actions according to the step c) are carried out, wherein, based on the three short time intervals measured accordingly and based on three longer measured time intervals measured prior to the three short measured time intervals an average value is calculated or a sum is calculated, respectively, and pressure-loading according to step e) is switched off when the average value or the sum of the short measured time intervals is smaller than the average value or the sum of the longer measured time intervals.

3. The method according to claim 1, wherein a duration of first pressure loading cycles according to the step c) is measured and the pressure loading cycles according to the step c) are switched off when the duration of the first pressure loading cycles according to step c) is shorter than a preset duration corresponding to a screw-on process.

4. The method according to claim 3, wherein the duration is measured for the first six pressure loading cycles according to step c).

5. The method according to claim 3, wherein an error message is generated by the electronic evaluation unit when pressure-loading according to the step c) is switched off immediately upon screwing on a loose nut or screw.

6. The method according to claim 3, wherein the time intervals of screwing on a loose nut or screw until biting, the time intervals of tightening the nut or the screw until the nominal pressure corresponding to the nominal torque is reached, and at least one time intervals after having reached the nominal pressure corresponding to the nominal torque without further rotation of the nut or screw are measured and pressure loading according to the step c) is switched off when at least the last time interval is shorter than the preceding ones.

7. A hydraulically operated power wrench for performing the method according to claim 1, comprising:

a piston-cylinder unit;

a ratchet bushing;

a pivotable lever that is pivoted by the piston-cylinder unit and provided with a ratchet arrangement for stepwise rotation of the ratchet bushing;

a drive unit with a motor-driven pump;

an electronic input unit for inputting parameters selected from nominal torque; nominal pre-load force; and screw size, material quality, thread pitch, and clamping length;

an electronic evaluation unit for determining a nominal pressure based on the parameters;

an adjustable pressure valve that is arranged between the piston-cylinder unit and the pump and is adjustable to the nominal pressure;

an actual pressure sensor;

a time measuring device for measuring a time interval of each pressure loading cycle from an initial pressure to the point in time when the nominal pressure is reached or from the beginning of pressure loading action up to the point in time when the nominal pressure is reached and subsequent pressure relief until the initial pressure is reached;

wherein the electronic evaluation unit controls the pressure loading cycles taking into account the measured time intervals such that the pressure loading cycles are switched off when at least the last measured time interval is shorter than at least the penultimate time interval.

8. The power wrench according to claim 7, wherein the electronic evaluation unit calculates average values or a sum of three short time intervals and of three longer time intervals immediately preceding the three short time intervals, wherein the pressure loading cycles are switched off when the average value or the sum of the three short time intervals is smaller than the average value or the sum of the three longer time intervals.

9. The power wrench according to claim 7, wherein the electronic evaluation unit measures the duration of the first pressure loading cycles and switches off the pressure loading cycles when the duration of the first pressure loading cycles is shorter than a predetermined duration of a screw-on action.

10. The power wrench according to claim 7, wherein the electronic evaluation unit generates an error message when the pressure loading cycles are switched off immediately when screwing on a nut or a screw.

11. The power wrench according to claim 7, wherein the electronic evaluation unit measures the time intervals when screwing on a loose nut or screw until biting, the time intervals for tightening the nut or screw until reaching the nominal pressure corresponding to the nominal torque, and at least one time interval after having reached the nominal pressure corresponding to the nominal torque without further rotation of the nut or screw and switches off the pressure loading cycles when at least the last measured time interval is shorter than the preceding time intervals.

* * * * *